US005661364A

United States Patent [19]

Kruskopf

[11] Patent Number: 5,661,364

[45] Date of Patent: Aug. 26, 1997

[54] SIMPLIFIED MECHANICAL PACKAGE FOR EL DISPLAYS

[75] Inventor: Mark Kruskopf, Portland, Oreg.

[73] Assignee: Planar Systems, Inc., Beaverton, Oreg.

[21] Appl. No.: 570,590

[22] Filed: Dec. 11, 1995

[51] Int. Cl.[6] ..... H05B 33/04

[52] U.S. Cl. ..... 313/512; 445/24

[58] Field of Search ..... 445/24, 23; 313/512, 313/506

[56] References Cited

U.S. PATENT DOCUMENTS

| | | | |
|---|---|---|---|
| 3,320,459 | 5/1967 | Stone | 313/521 |
| 4,558,797 | 12/1985 | Mitchell | 220/84 |

OTHER PUBLICATIONS

A drawing of Planar Systems, Inc., Model EL 7768MS which appeared in a printed publication in Aug., 1993.

*Primary Examiner*—Kenneth J. Ramsey

*Attorney, Agent, or Firm*—Chernoff, Vilhauer, McClung & Stenzel, LLP

[57] ABSTRACT

A construction for an electroluminescent display device comprises an electroluminescent element stack having an outer edge and including a light emitting electroluminescent panel, an electronic circuit board, and a connector electrically coupling the electronic circuit board to the electroluminescent panel. A frame member of generally U-shaped cross-section fits over and compresses the electroluminescent element stack along the outer edge. Additionally, a method of constructing an electroluminescent display device comprises the steps of forming an electroluminescent element stack having a light emitting panel, an electronic circuit board and a connector coupling the electronic circuit board to the electroluminescent panel. The electroluminescent element stack is formed to have an outer edge. A frame member is formed to have generally U-shaped cross-section and resilient arms. The frame member is fitted onto the outer edge of the electroluminescent element stack so as to compress the electroluminescent element stack together. The frame member may be formed by extrusion. The connector may be an elastomeric connector.

13 Claims, 1 Drawing Sheet

SIMPLIFIED MECHANICAL PACKAGE FOR EL DISPLAYS

BACKGROUND OF THE INVENTION

This invention relates to the construction of electroluminescent display devices having a light emitting electroluminescent panel electrically coupled to an electronic circuit board, and in particular to a construction and method of fabrication of such panels that makes use of a novel framing technique that is efficient and cost effective.

Traditionally, electroluminescent (EL) display devices have been constructed by compressing together a light emitting EL panel, an elastomeric connector, and an electronic circuit board in a sheet metal frame. A foam gasket between the sheet metal frame and the light emitting EL panel provides the compression force to squeeze together the light emitting EL panel, the elastomeric connector, and the electronic circuit board. A rigid spacer positions the elastomeric connector and determines a compressed thickness. A desirable object in the design of EL display devices is for them to be as thin as possible, but the gasket and the sheet metal frame add to the thickness of the fully constructed device.

The prior method of constructing such EL display devices requires a large, complicated machine to assemble the components. The machine aligns the light emitting EL panel and electronic circuit board, compresses the components together, and bends tabs on the sheet metal frame to hold the components together. The compression force is provided by an air cylinder above the light emitting EL panel. The air cylinder is usually oriented vertically, thus requiring substantial vertical clearance above the assembling machine.

The prior method of constructing EL display devices also requires precise dimensions for each component part. EL display devices need a reliable electrical connection between the light emitting EL panel and the electronic circuit board. The prior method of constructing EL display devices maintained the electrical connection by using a foam gasket to compress an elastomeric connector between the light emitting EL panel and the electronic circuit board. If the combined thickness of the foam gasket, EL panel, elastomeric connector, and electronic circuit board is too thin, then the compression force provided by the foam gasket will be insufficient to maintain a reliable electrical connection between the light emitting EL panel and the electronic circuit board. However, if the combined thickness is too thick, it is difficult for the machine to compress the components together and bend the tabs on the sheet metal frame to hold the components together. Accordingly, the thickness of each component is critical to achieve both ease of assembly of the EL display device and a reliable electrical connection.

What is therefore desired is a construction and method of fabrication for an EL display device that is efficient, cost effective, maintains a reliable electrical connection between the light emitting EL panel and the electronic circuit board, and results in a thin EL display device.

SUMMARY OF THE INVENTION

The present invention overcomes the aforementioned drawbacks of the prior art by providing a construction for an EL display device. The construction includes an EL element stack having an outer edge. The EL element stack consists of a light emitting EL panel, an electronic circuit board, and a connector electrically coupling the electronic circuit board to the light emitting EL panel. A frame member of generally U-shaped cross section, with resilient arms, fits over and compresses the EL element stack along the outer edge of the stack.

The present invention also includes a method for constructing an EL display device. First, an EL element stack is formed, comprising a light emitting EL panel, an electronic circuit board, and a connector electrically coupling the electronic circuit board to the light emitting panel, preferably along an outer edge of the stack. A frame member is then formed which has a generally U-shaped cross-section, with resilient arms. The frame member is then fitted over the EL element stack along its outer edge and pushed onto the stack, so that it compresses the EL element stack together.

In the preferred embodiment, the frame member is formed by extrusion and the connector is an elastomeric connector. In addition, the EL element stack includes a back plate adjacent to the light emitting panel. The back plate has a side that is adjacent to the elastomeric connector to support the elastomeric connector.

In the preferred embodiment, one of the resilient arms has a lip. The electronic circuit board has one or more protrusions along a bottom margin. The frame is fitted over the outer edge of the stack by fitting the lip over the protrusions and rotating the frame about an axis parallel to the outer edge. The lip and protrusions fit together and thereby provide a secure coupling of the frame to the EL stack.

In another embodiment, the resilient arms are convex flared resilient arms which engage the stack by direct sideways pressure.

This construction and method of construction for an EL display device has several advantages over the prior art. It results in an EL display device which efficiently and cost effectively secures the light emitting EL panel, the electronic circuit board, and the connector electrically coupling the light emitting EL panel and the electronic circuit board. The invention allows the EL display device to be assembled without using large complicated machines to compress the components of the EL display device, eliminates the need for precise dimensions of each component of the EL display panel, and results in a thin EL display device. The construction also maintains a reliable electrical connection between the electronic circuit board and the EL display panel. In addition, the invention allows the frame member to be fabricated by extrusion, and the connector between the light emitting EL panel and the electronic circuit board to be an elastomeric connector.

DETAILED DESCRIPTION OF THE PREFERRED EMBODIMENT

Figure 1A:
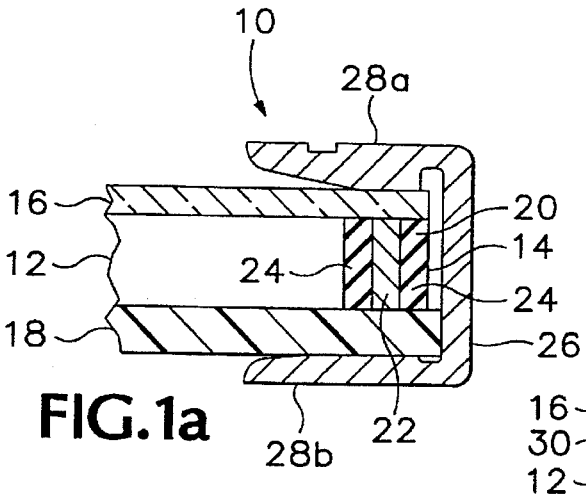
FIG. 1*a* is a partial side sectional view of an EL display device constructed in accordance with the present invention.

FIG. 1*a* is a partial cross sectional showing of an EL display device 10. The EL display device 10 has an EL element stack 12 with an outer edge 14. The EL element stack includes a light emitting EL panel 16, an electronic circuit board 18, and a connector 20 electrically coupling the electronic circuit board to the light emitting EL panel. The connector 20 may be an elastomeric connector. FIG. 1*a* shows a connector 20 composed of a central layer 22 of resilient, elastomeric conductive material sandwiched between two resilient support layers 24. A frame member 26 of generally U-shaped cross section fits over and compresses the EL element stack 12 along the outer edge 14.

FIG. 1*a* shows an embodiment in which the frame member 26 has convex flared resilient arms 28*a* and 28*b*. The resilient arms 28*a* and 28*b* provide the compression force necessary to secure the EL element stack 12 and to maintain a reliable electrical connection between the electronic circuit board 18 and the light emitting EL panel 16. Because the arms 28*a* and 28*b* provide the compression force, the foam gasket of the prior art may be eliminated, thus reducing the thickness of the EL display device. Moreover, unlike prior devices, the EL element stack 12 does not require a rigid spacer.

The convex flared arms 28*a* and 28*b* of the frame member 26 allow the EL display device 10 to be constructed by fitting the frame member 26 onto the outer edge 14 of the stack. Because the arms 28*a* and 28*b* are convex, the frame member 26 is easily fitted into place, as the arms provide little, if any compressive force as they engage the outer edge 14, but provide increasing compressive force until the frame member 26 is securely in place adjacent to the outer edge 14. The flared, resilient arms 24 expand as necessary to fit over the outer edge 14 while maintaining a compressive force, thus eliminating the need for precision as to the dimensions of each component of the EL element stack 12. This method of construction is accordingly more efficient than the prior art and eliminates the need for a large assembly machine.

The frame member 26 may be formed by extrusion, and in the preferred embodiment is made from extruded aluminum, which is less expensive than the sheet metal frame used in the prior art.

Figure 1B:
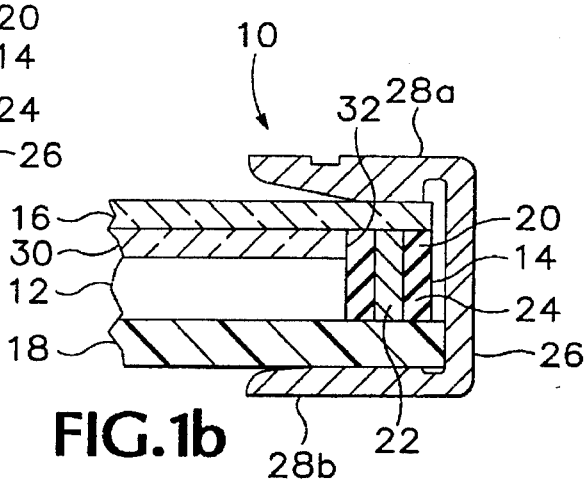
FIG. 1*b* is a partial side sectional view of an embodiment of an EL display device constructed in accordance with the present invention.

FIG. 1*b* shows an alternative EL display device 10. The EL element stack 12 includes a back plate 30, in addition to the light emitting EL panel 16, electronic circuit board 18, and connector 20. The back plate has a side 32 and may be positioned so that the side 32 is adjacent to the connector 20. Placing the side 32 adjacent to the connector 20 allows the backplate 30 to support the connector.

Figure 2A:
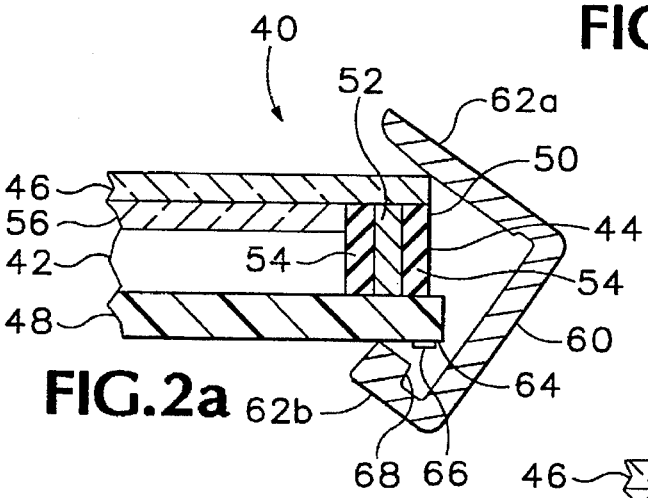
FIG. 2*a* is a partial side sectional view of the preferred embodiment of an EL display device being constructed in accordance with the present invention.

FIG. 2*a* shows the preferred embodiment of an EL display device 40. The EL display device 40 has an EL element stack 42 and an outer edge 44. The EL element stack 42 includes a light emitting EL panel 46, electronic circuit board 48, a connector 50 and a backplate 56. The connector 50 has a central layer 52 of resilient, elastomeric conductive material sandwiched between two resilient support layers 54. A backplate 56 has a side 58 that is adjacent to the connector 50 and supports the connector 50. A frame member 60 has resilient arms 62*a* and 62*b* and fits over the outer edge 44.

The electronic circuit board 48 has a bottom margin 64 with one or more protrusions 66 along the bottom margin 64. An arm 62*b* of the frame 60 has a lip 68 which fits over the protrusions 66. The lip 68 and protrusions 66 fit together so that when the frame 62 is fitted over the outer edge 50, the frame 60 is securely coupled to the EL element stack 42. The frame 60 may be fitted over the outer edge 44 by first placing the lip 68 over the protrusions 66. The frame 60 is then rotated about an axis parallel to the outer edge 50 so that the arm 62*a* is fitted over the light emitting EL panel 46.

In the preferred embodiment, the arm 62*a* is a convex flared resilient arm. The resilient arms 62*a* and 62*b* provide the compression force necessary to secure the EL element stack 42 and to maintain a reliable electrical connection between the electronic circuit board 48 and the light emitting EL panel 46.

Figure 2B:
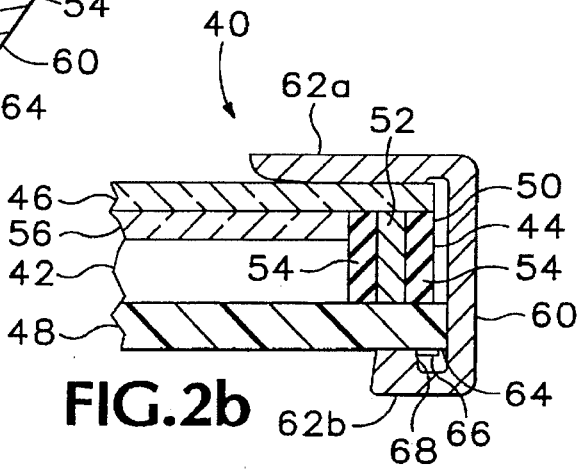
FIG. 2*b* is a partial side sectional view of the preferred embodiment of an EL display device constructed in accordance with the present invention.
Figure 3:
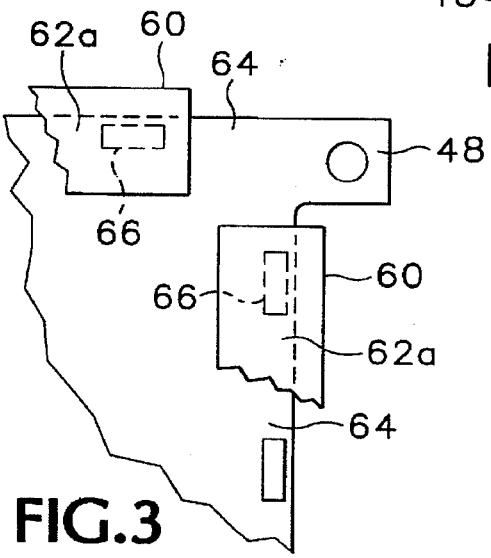
FIG. 3 is a partially cutaway view of part of the preferred embodiment of the EL display device shown in FIG. 2*b* showing the electronic circuit board, protrusions, and a frame arm fitted over the electronic circuit board.

FIG. 2*b* shows the preferred embodiment fully fitted together. FIG. 3 shows the preferred embodiment as viewed from beneath the electronic circuit board 48 and fully fitted together.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A construction for an electroluminescent display device comprising:

(a) an electroluminescent element stack having an outer edge and including a light emitting electroluminescent panel, an electronic circuit board and a connector electrically coupling the electronic circuit board to the electroluminescent panel; and (b) a frame member of generally U-shaped cross section, said frame member having resilient arms fitting over and compressing the electroluminescent element stack along said outer edge thereof.

2. A construction for an electroluminescent display device according to claim 1, wherein the electroluminescent element stack includes a back plate adjacent to the light emitting electroluminescent panel.

3. A construction for an electroluminescent device according to claim 2 wherein the backplate has a side, the side being adjacent to the connector so as to support the connector.

4. A construction for an electroluminescent display device according to claim 1 wherein the resilient arms are convex flared resilient arms.

5. A construction for an electroluminescent display device according to claim 1 wherein the electronic circuit board has a bottom margin and one or more protrusions along said bottom margin, and one of said resilient arms has a lip fitting over said protrusions so that the frame is securely coupled to the stack.

6. A method of constructing an electroluminescent display device comprising the steps of:

(a) forming an electroluminescent element stack comprising a light emitting panel, an electronic circuit board and a connector coupling the circuit board to the electroluminescent panel, said stack formed to have an outer edge;

(b) forming a frame member of generally U-shaped cross section and providing said frame member with resilient arms; and (c) fitting said frame member onto said outer edge of said electroluminescent element stack so as to press said stack together.

7. The method of claim 6 wherein the electroluminescent element stack includes a back plate adjacent to the light emitting electroluminescent panel.

8. The method of claim 7 wherein the backplate is formed to have a side, and said connector is positioned adjacent to said side.

9. The method of claim 6 wherein the frame member is formed by extrusion.

10. The method of claim 6 wherein the connector is an elastomeric connector.

11. The method of claim 6 wherein the resilient arms are formed to be convex flared resilient arms.

12. The method of claim 6 wherein the electronic circuit board is formed to have a bottom margin and one or more protrusions along said bottom margin, and one of the resilient arms is formed to have a lip, and the frame is fitted over the outer edge by fitting the lip over the protrusions and rotating the frame about an axis parallel to the outer edge so that the frame is securely coupled to the stack.

13. The method of claim 12 wherein the protrusions are formed from solder.

* * * * *